US006597098B2

(12) United States Patent
Nishikata

(10) Patent No.: US 6,597,098 B2
(45) Date of Patent: Jul. 22, 2003

(54) CATHODE RAY TUBE

(75) Inventor: Koichi Nishikata, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 1 day.

(21) Appl. No.: 09/749,099

(22) Filed: Dec. 27, 2000

(65) Prior Publication Data

US 2001/0010448 A1 Aug. 2, 2001

(30) Foreign Application Priority Data

Feb. 1, 2000 (JP) ..... 2000-023686

(51) Int. Cl.[7] ..... H01J 29/10
(52) U.S. Cl. ..... 313/476; 313/408; 313/461
(58) Field of Search ..... 313/364, 476, 313/479, 482, 402, 408, 2.1, 461

(56) References Cited

U.S. PATENT DOCUMENTS 4,031,553 A * 6/1977 Sumiyoshi et al. ..... 348/824
4,567,626 A 2/1986 Kimbrough ..... 220/2.1 A
6,150,760 A * 11/2000 Tsuchiya et al. ..... 313/2.1

FOREIGN PATENT DOCUMENTS

FR 2 493 040 10/1981
JP 59-180940 10/1984
JP 60-9037 1/1985
JP 1-106057 7/1989
JP 5-174734 7/1993
JP 5-90796 12/1993
JP 6-96699 4/1994
KR 91-1600 U 1/1991

OTHER PUBLICATIONS

European Search Report for EP 01 10 2120. Jul. 25, 2001.

* cited by examiner

*Primary Examiner*—Don Wong
*Assistant Examiner*—Thuy Vinh Tran
(74) *Attorney, Agent, or Firm*—Merchant & Gould, P.C.

(57) ABSTRACT

A cathode ray tube includes a panel and a reinforcing band for implosion-protection that is located around a side wall of the panel. The reinforcing band is formed by folding over one side in a width direction of a belt-like metal plate (6) so as to have a partially twofold structure and by joining both end portions of the belt-like metal plate (6) so as to be in the shape of a closed loop extending along the side wall of the panel. One end portion and the other end portion of the both end portions are joined together so as to achieve a threefold structure in at least one part. This can achieve a strong reinforcing band at a low cost without using a special member.

4 Claims, 4 Drawing Sheets

CATHODE RAY TUBE

BACKGROUND OF THE INVENTION

1. Field of the Invention

The present invention relates to a cathode ray tube used in a computer monitor or a television receiver. It relates in particular to an implosion-protection reinforcing band for the same.

2. Description of the Related Art

A widely known reinforcing band to be mounted around a panel of a cathode ray tube is, for example, a reinforcing band 18 formed in the shape of a closed loop, which is shown in FIG. 6. The reinforcing band 18 is constituted by a band main body 16 that is formed by folding over one side in a width direction of a belt-like metal plate along a fold portion 5 so as to have a partially twofold structure and a joint metal plate 17 that joins end portions of the band main body 16 in their abutting portion.

Being formed with the folded belt-like metal plate, the reinforcing band 18 has a large strength. Thus, it is used in particular for a large cathode ray tube that requires a large force when mounting the reinforcing band around the panel.

However, due to the use of the joint metal plate 17, the reinforcing band 18 described above had following problems.

The joint metal plate 17 was likely to be subjected to an outward force that often was generated in the abutting portion of the band main body 16. In order to suppress this force, in many cases, it was necessary to use a strong material or a thick material for the joint metal plate 17 so that the material or the thickness of the joint metal plate 17 and that of the band main body 16 were different. This caused the problem of increasing material cost or of difficult welding. In addition, a member other than the band main body 16 was used as the joint metal plate 17, increasing the number of components or manufacturing steps as well as the material cost.

SUMMARY OF THE INVENTION

It is an object of the present invention to solve the problems described above and to achieve a strong reinforcing band without using a special member so as to provide a cathode ray tube including this reinforcing band.

In order to solve the problems described above, a cathode ray tube of the present invention includes a panel, and a reinforcing band for implosion-protection that is located around a side wall of the panel. The reinforcing band is formed by folding over one side of a belt-like metal plate so as to have a partially twofold structure and by joining both end portions of the belt-like metal plate so as to be in the shape of a closed loop extending along the side wall of the panel. One end portion and the other end portion of the both end portions are joined together so as to achieve a threefold structure in at least one part.

In this manner, the reinforcing band can be joined strongly without using any joint metal plate. Thus, while maintaining a material cost and a manufacturing cost at a low level, it is possible to ensure a sufficient fastening strength of the reinforcing band, thereby achieving the cathode ray tube provided with the reinforcing band having a high implosion-protection effect.

In the above cathode ray tube, it is preferable that in one end portion of the both end portions of the reinforcing band, an edge of a front plate portion extends in a longitudinal direction of the reinforcing band with respect to an edge of a back plate portion, while in the other end portion, an edge of a back plate portion extends in the longitudinal direction of the reinforcing band with respect to an edge of a front plate portion.

This makes it possible to use the material of the reinforcing band without wasting it, thus achieving an overlap easily in which at least one part has the threefold structure.

Furthermore, it is preferable that corners of the both end portions of the reinforcing band are cut off.

Also, it is preferable that an edge of the back plate portion of the reinforcing band that is located closest to the panel has a notch in a portion corresponding to a protrusion on the side wall of the panel.

In this manner, it is possible to prevent the panel side wall from being scratched.

DESCRIPTION OF THE PREFERRED EMBODIMENTS

The following is a description of the embodiment of the present invention, with reference to the accompanying drawings.

Figure 2:
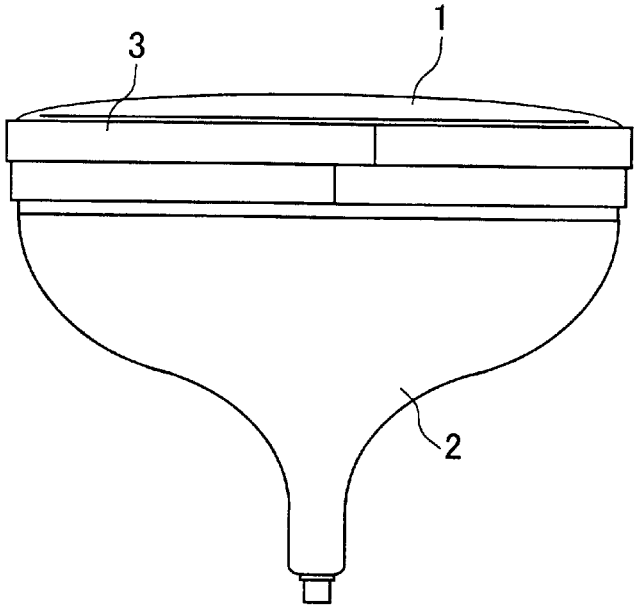
FIG. 2 is a side view of the cathode ray tube according to the present invention.

FIG. 2 is a side view of a cathode ray tube in accordance with an embodiment of the present invention. An envelope includes a panel 1 on whose inner surface a phosphor screen is formed (not shown in the drawing) and in which a shadow mask faces the phosphor screen (not shown in the drawing) and a funnel 2 having an electron gun (not shown in the drawing) therein. A reinforcing band 3 is mounted around the circumference of a side wall of the panel 1.

Figure 3:
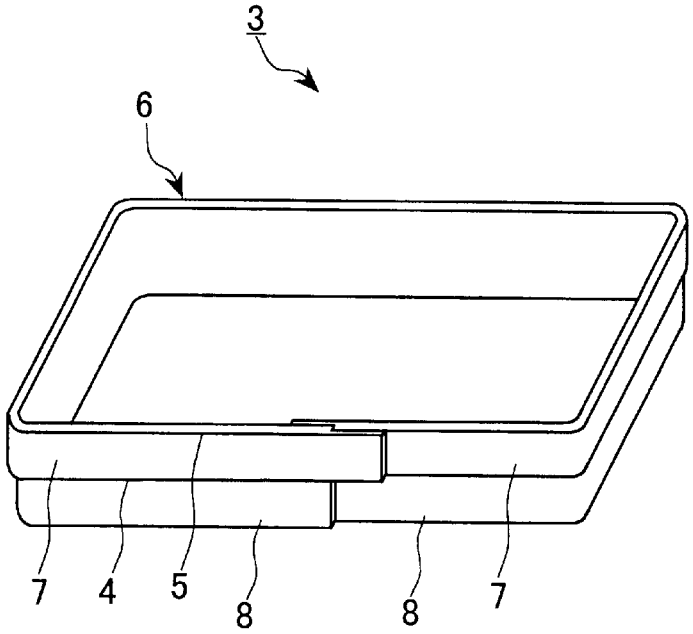
FIG. 3 is a perspective view showing the reinforcing band of the cathode ray tube according to the present invention.

As shown in FIG. 3, the reinforcing band 3 is formed by folding over one side 4 in a width direction of a belt-like metal plate 6 along a fold portion 5 so as to have a partially twofold structure and by joining end portions of the belt-like metal plate 6 so as to be in the shape of a closed loop. A front plate portion 7 that is folded over is located on the circumferential side of the reinforcing band 3 and extends along a back plate portion 8. The front plate portion 7 is narrower than the back plate portion 8. The internal circumference of this reinforcing band 3 is a little shorter than the circumference of the panel side wall at a normal temperature. After the reinforcing band 3 is heated so as to expand thermally, it is mounted around the circumference of the panel. When cooled down to a normal temperature afterwards, the reinforcing band 3 embraces the side wall of the panel tightly, thus maintaining a balance with an air pressure inside the panel. The reinforcing band 3 is mounted around the panel such that the fold portion 5 that is folded over faces toward a screen.

Next, the following is a description of a junction of the reinforcing band, which best illustrates features of the present invention.

Figure 1A:
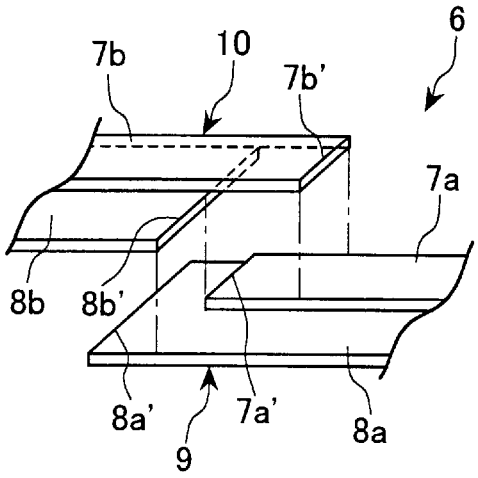
FIG. 1A illustrates a shape of end portions of a reinforcing band and how they are overlapped at a junction in a cathode ray tube according to the present invention.
Figure 1C:
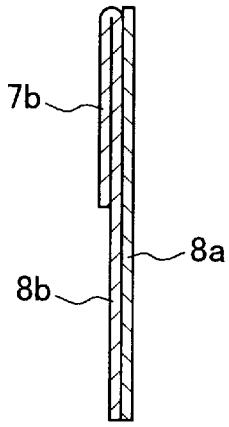
FIG. 1C shows a cross-section taken along the line 1C—1C in FIG. 1B.
Figure 1B:
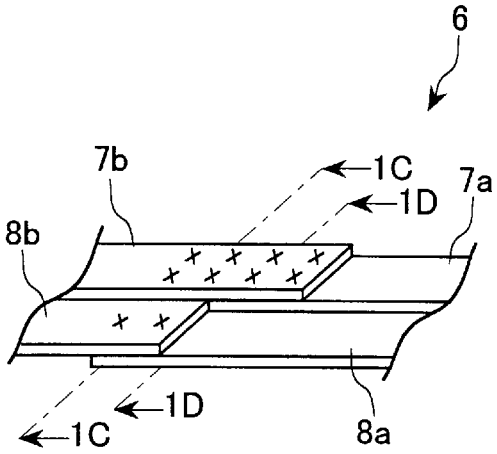
FIG. 1B illustrates how the end portions of the reinforcing band are joined at the junction in the cathode ray tube according to the present invention.

FIG. 1A illustrates a shape of the both end portions of the reinforcing band and how they are overlapped, and FIG. 1B illustrates how the both end portions are overlapped and joined.

Figure 1D:
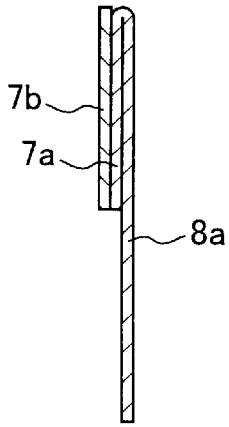
FIG. 1D shows a cross-section taken along the line 1D—1D in FIG. 1B.

The belt-like metal plate to be the reinforcing band is folded over in an upper part in the drawing so as to have the partially twofold structure. In both right and left end portions to be joined together, edges of the front plate portions are located to the right of edges of the back plate portions in the drawing. In other words, in a right end portion 9 in the drawing, a back plate portion 8*a* extends to the left with respect to an edge 7*a*' of a front plate portion 7*a*. In a left end portion 10, a front plate portion 7*b* extends to the right with respect to an edge 8*b*' of a back plate portion 8*b*. As shown with alternate long and short dash lines in FIG. 1A, a part of the left front plate portion 7*b* is overlapped on a part of the right front plate portion 7*a*, and a part of the left back plate portion 8*b* is overlapped on a part of the right back plate portion 8*a*. Consequently, the reinforcing band is overlapped so as to achieve a threefold structure in at least one part. (In this case, the left front plate portion 7*b*+the right front plate portion 7*a*+the right back plate portion 8*a* are overlapped, and the left front plate portion 7*b*+the left back plate portion 8*b*+the right back plate portion 8*a* are overlapped.) These overlapped right and left end portions are joined, for example, by welding at the positions indicated by × in FIG. 1B. FIG. 1C shows a cross-section taken along the line 1C—1C in FIG. 1B, and FIG. 1D shows a cross-section taken along the line 1D—1D in FIG. 1B.

As an embodiment of the present invention, a reinforcing band used in a cathode ray tube for a television receiver having a 68-cm-diagonal screen is discussed in the following. The belt-like metal plate had a thickness of 1.2 mm, a width of the front plate portion of 30 mm and a width of the back plate portion of 55 mm. The longitudinal band length from the edge 7*b*' of the left front plate portion 7*b* to the edge 8*b*' of the left back plate portion 8*b* and that from the edge 7*a*' of the right front plate portion 7*a* to the edge 8*a*' of the right back plate portion 8*a* in FIG. 1A were both 35 mm. As shown in FIG. 1B, there were eight welding points in the portion of the threefold structure and two welding points in the portion of the twofold structure. Spot welding was conducted by sandwiching a plurality of metal plates by two electrodes. The size of the belt-like metal plate and the number of the welding points can be selected suitably according to the size of the cathode ray tube, the thickness of the belt-like metal plate etc.

In order to confirm the joint condition of the reinforcing band described in the present embodiment, a usual type of test was carried out so that the tensile strength was measured until a breaking limit of the reinforcing band. This found that breakage occurred in a band main body instead of the junction and that the reinforcing band fell within the usual range of standards. Therefore, the joint strength was sufficiently high under the joining condition of the present embodiment, thus maintaining the fastening strength of the panel.

As described above, the reinforcing band of the cathode ray tube of the present invention can maintain a sufficient fastening strength without using a special joint metal plate for joining. Thus, it is possible to omit a step of providing the joint metal plate and to keep the material cost at a lower level.

Furthermore, since all the metal plates to be welded are made of the same material and have the same thickness, an equal electric power can be applied to the two electrodes for welding. Consequently, it is possible to prevent the problem that one of the electrodes is likely to be deteriorated earlier than the other, thus achieving a longer life of the electrodes and suppressing loss of the electric power applied to the electrodes.

Also, since the thick joint metal plate is not used, it is possible to reduce the size of the reinforcing band, which serves as the outermost part of the cathode ray tube, thereby saving the space of the set enclosing the cathode ray tube.

Figure 4:
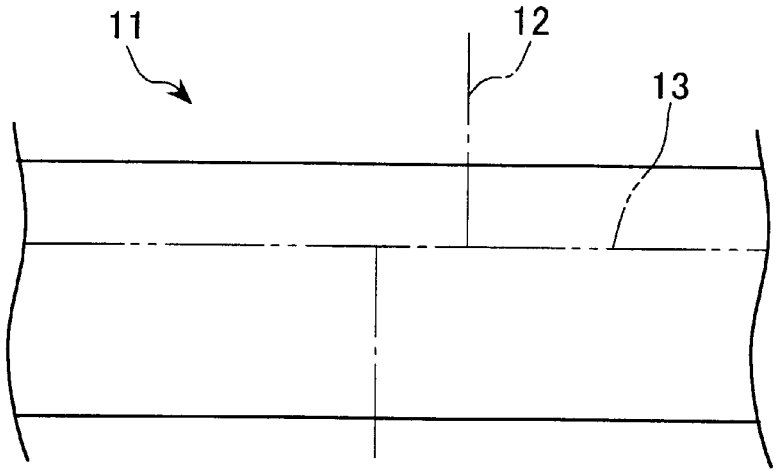
FIG. 4 illustrates how to use a material of a belt-like metal plate to be the reinforcing band of the cathode ray tube according to the present invention.

Moreover, at the junction of the belt-like metal plate to be the reinforcing band, in one end portion, the back plate portion extends in the longitudinal direction with respect to the front plate portion, while in the other end portion, the front plate portion extends in the longitudinal direction with respect to the back plate portion. This makes it possible to use a material plate for this belt-like metal plate without wasting it. In other words, as shown in FIG. 4, a desired length of the belt-like metal plate is cut off stepwise along an alternate long and short dash line 12 from an elongated material plate 11, followed by folding it over along a double-dashed line 13, thereby forming the reinforcing band easily without any waste.

Figure 5:
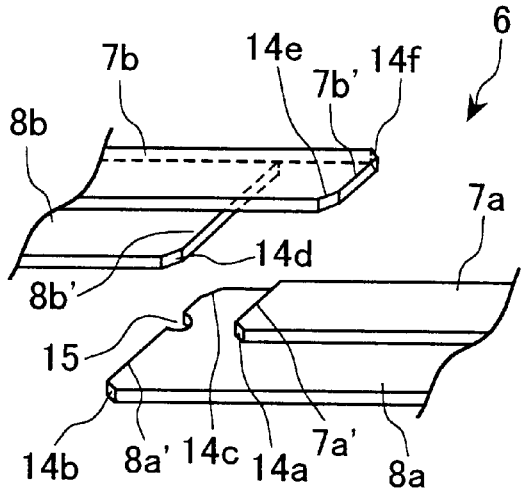
FIG. 5 illustrates another shape of end portions of a reinforcing band at a junction in the cathode ray tube according to the present invention.
Figure 6:
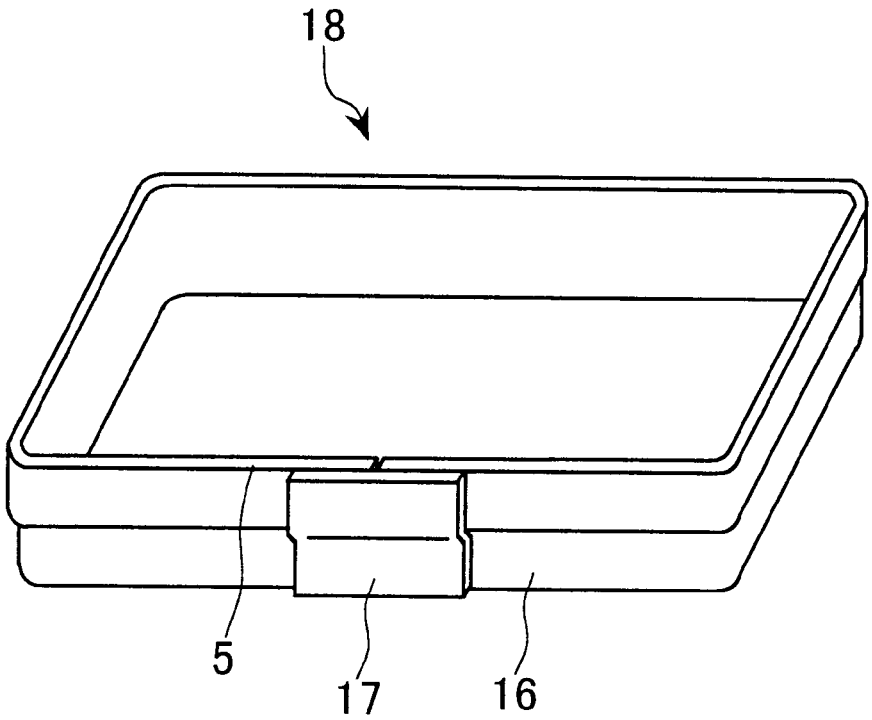
FIG. 6 PRIOR ART
FIG. 6 is a perspective view showing a conventional reinforcing band.

It is more preferable here that corners of the right and left end portions are cut off so as to form chamfers 14*a* to 14*f* as shown in FIG. 5. In this manner, since the corners of the end portions are not sharp anymore, the corners do not scratch the outer surface of the panel easily during the manufacture of the cathode ray tube, which is further effective in preventing implosion. Also, even if there is a little displacement in the width direction when the end portions are overlapped, a sharp corner is less likely to extend beyond a side of the reinforcing band, promoting the safe handling for workers. The chamfer may be formed by cutting off the corner of the end portion at an angle of 45° with respect to the longitudinal direction of the belt-like metal plate as shown in FIG. 5, or by cutting the corner into a circular arc.

Furthermore, a part of the edge 8*a*' of the right back plate portion 8*a*, which is located closest to the panel when overlapped, may be cut into a curved shape so as to form a notch 15 at a position corresponding to a protrusion on the side wall of the panel. This protrusion is called a mold match line. In this case, the mold match line is less likely to be scratched by the back plate portion, which also is effective in preventing implosion.

In the reinforcing band illustrated in the present embodiment, the edge 8*b*' of the left back plate portion 8*b* and the edge 7*a*' of the right front plate portion 7*a* abut as shown in FIGS. 1A to 1D and FIG. 5. However, the present invention is not limited to this structure, and the edge 8*b*' of the left back plate portion 8*b* and the edge 7*a*' of the right front plate portion 7*a* may be spaced away from each other. In this case, even if an error is made in the dimension of the belt-like metal plate that has been cut off as in FIG. 4, the internal circumference of the reinforcing band can be made constant, thus preventing a defective dimension. This is advantageous in manufacturing the cathode ray tube.

Moreover, in FIGS. 1 to 5 illustrating the present embodiment, the belt-like metal plate has a structure that the left end portion is overlapped on the right end portion. However, it should be understood that the two end portions can be overlapped in a reversed manner. In this case, in the left end portion, the back plate portion 8*b* extends to the right with respect to the edge of the front plate portion 7*b*, while in the right end portion, the front plate portion 7*a* extends to the left with respect to the edge of the back plate portion 8*a*.

In addition, the present embodiment illustrated the spot welding as a method for bonding the end portions of the belt-like metal plate. Alternatively, the end portions may be joined by bonding such as a plasma welding or a laser welding or by applying a force to form a tight joint such as caulking.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A cathode ray tube comprising:

a panel; and a reinforcing band for implosion-protection that is located around a side wall of the panel;

wherein the reinforcing band is formed by folding over one side of a belt-like metal plate having first and second end portions so as to have a partially twofold structure and by overlapping and joining the first and second end portions of the belt-like metal plate so as to be in the shape of a closed loop extending along the side wall of the panel, and the first end portion and the second end portion form a threefold structure in at least one part of the overlapped portion of the first and second end portions.

2. The cathode ray tube according to claim 1, wherein corners of the first and second end portions of the reinforcing band are cut off.

3. The cathode ray tube according to claim 1, wherein in the first end portion of the reinforcing band, an edge of a front plate portion extends in a longitudinal direction of the reinforcing band with respect to an edge of a back plate portion, while in the second end portion, an edge of a back plate portion extends in the longitudinal direction of the reinforcing band with respect to an edge of a front plate portion.

4. The cathode ray tube according to claim 3, wherein an edge of the back plate portion of the reinforcing band that is located closest to the panel has a notch in a portion corresponding to a protrusion on the side wall of the panel.

* * * * *